US008715145B1

(12) United States Patent
Winbush et al.

(10) Patent No.: US 8,715,145 B1
(45) Date of Patent: May 6, 2014

(54) EXERCISE APPARATUS FOR ACTIVATING THE MUSCLES

(75) Inventors: James Robert Winbush, Fort Lee, NJ (US); Mahtab Zinati, Fort Lee, NJ (US)

(73) Assignee: Absrunner, LLC

( * ) Notice: Subject to any disclaimer, the term of this patent is extended or adjusted under 35 U.S.C. 154(b) by 622 days.

(21) Appl. No.: 12/927,386

(22) Filed: Nov. 12, 2010

(51) Int. Cl.
*A63B 21/02* (2006.01)

(52) U.S. Cl.
USPC ..... 482/124; 482/69

(58) Field of Classification Search
USPC ..... 482/51, 69, 74, 121, 124, 907; 119/770, 119/857
See application file for complete search history.

(56) References Cited

U.S. PATENT DOCUMENTS 3,697,065 A * 10/1972 Glassburner, Jr. ..... 482/14
5,993,362 A * 11/1999 Ghobadi ..... 482/124
6,125,792 A * 10/2000 Gee ..... 119/770
6,436,011 B1 * 8/2002 Cook ..... 482/69
7,147,590 B2 * 12/2006 Toven ..... 482/51
7,874,970 B2 * 1/2011 Glisan ..... 482/124

* cited by examiner

*Primary Examiner* — Stephen Crow
(74) *Attorney, Agent, or Firm* — Kenneth P. Glynn, Esq.; Deirdra M. Meagher, Esq.

(57) ABSTRACT

An exercise apparatus useful for activating particular muscles, for example, the oblique and bicep muscles that are engaged when an individual is running while wearing the apparatus. Apparatus may include a belt with two ends, mountable on the individual's torso region; securement means on the belt's ends for adjustably securing apparatus about individual's torso region; a pair of shoulder straps with two ends on the strap's distal portions, configured to be hung on the individual's shoulders extending from apparatus' rear to its front, whereby these ends of the shoulder strap are connected to the belt; a hand grip element extending from either the back support member or the rear shoulder straps; and the back support member positioned on the individual's back when worn, whereby the individual may insert their hands into the hand grip element when running, such that the individual's hands are immovably positioned behind their neck.

10 Claims, 4 Drawing Sheets

EXERCISE APPARATUS FOR ACTIVATING THE MUSCLES

FIELD OF THE INVENTION

The present disclosure relates generally to an exercise apparatus useful for activating particular muscles, for example, the oblique and bicep muscles that are engaged when an individual is running while wearing the apparatus. Apparatus may include a belt with two ends, mountable on the individual's torso region; securement means on the belt's ends for adjustably securing apparatus about individual's torso region; a pair of shoulder straps with two ends on the strap's distal portions, configured to be hung on the individual's shoulders extending from apparatus' rear to its front, whereby these ends of the shoulder strap are connected to the belt; a hand grip element extending from either the back support member or the rear shoulder straps; and the back support member positioned on the individual's back when worn, whereby the individual may insert their hands into the hand grip element when running, such that the individual's hands are immovably positioned behind their neck.

BACKGROUND OF THE INVENTION

People participate in various exercises, such as aerobic activities, weight training, resistance training, and functional dynamics, to obtain higher levels of fitness. As is common in the fitness industry, basic exercises can be accomplished by using equipment. The use of exercise equipment for physical fitness comes in many forms. The devices range from the simple, jump rope, to the more sophisticated Nautilus apparatus and Solofex devices.

Varied types of exercise apparatuses have been available over the years, with such use being based on the idea of targeting for example, heart rate, and improving cardiovascular health, while other physical training apparatuses specifically target certain muscle groups for defining, toning and strengthening them. The configuration of these apparatuses varies as they invariably depend on the particular needs and circumstances of the purpose for which they will be applied to.

Some exercise apparatuses come in the form of specialized vests, body suits, or belts which are attached to the individual's upper body torso or waist, and typically equipped with a resistance component to engage the individual's hands or legs. Known devices for providing resistance to motion during multidirectional movement include weighted vests, belts, and arm or leg bands. These devices have disadvantages which will become more apparent with reference to the following disclosure. For example, one disadvantage of a weighted wearable devices is that they are often bulky and cumbersome, which can inhibit effective movement and provide resistance in a limited way while running, jogging or walking. The prior art does not provide a effective means for isolating and targeting specific muscle groups without resistance bands or weights during running.

Studies have shown that increased lung capacity in an individual will attain better results in cardiovascular exercise. Lung capacity determines how well the oxygen flows throughout an individual's body. Exercises that increase an individual's lung capacity allow an individual to achieve better results. Direct results can be seen with swimmers, who over time develop the capacity to hold their breath under water for a significant period because of their increased lung capacity. In general athletes with increased lung capacity have greater strength, endurance and stamina.

Runners who desire to have greater strength and endurance need to integrate the strengthening of muscle groups with exercises that increase lung capacity while running. An exercise helpful to increase lung capacity is raising an individual's arms over their head.

Several weight bearing exercise equipment strive for similar results where an individual may perform weight lifting exercises to increase lung capacity. In weight training exercises the raising of an individual's hands with weights above their head directly affects the strengthening of their bicep muscles. These exercises produce limited success, in view of the fact there are limited alternatives for duplicating the cardiovascular exercises while running. To date, the prior art has not resolved this need with the existing cardiovascular equipment. Thus, there is a need for cardiovascular equipment that will allow the individual to keep their arms up over their head during cardiovascular exercises and provide support for the hands during the same.

The prior art does not provide the benefit of increasing lung capacity while targeting the oblique and bicep muscles through a passive workout while an individual is running. Additionally, several existing cardiovascular equipment promote the natural involuntary arm swinging motion during running which contributes to reducing the individual's endurance while exercising. There remains a need for an affordable, portable, exercise apparatus that is simple and effective, easily fitted on an individual, which will improve the cardiovascular health by increasing the lung capacity of the individual with the benefits of engaging the oblique and bicep muscles while running.

The apparatus disclosed herein involves the passive workout for the oblique and bicep muscles when the hands of the individual grasp the handle grip element installed on the back of the apparatus while running. The arms raised above the individual's head and the hands held stationary behind the neck while running activate the oblique and bicep muscles, thereby providing a passive workout for these muscles while running, where the individual's natural bodyweight is the resistance, or acts as the only resistance, and no other additional weight or resistance is required. The apparatus disclosed herein permits the arms to be raised up over the individual's head and the hands held stationary behind the neck, exposing the oblique muscles, increasing the tension and stress on the oblique muscles for the duration of time that the individual is running. Thus the apparatus disclosed herein targets, strengthens, tones and adds definition to the oblique muscles. Additionally when the arms are brought up over the head and held stationary behind the neck, the arm muscles, including the bicep muscles, are engaged and exposed to the natural stress and tension for the duration of time that the individual is running. Thus the apparatus disclosed herein also targets, strengthens, tones and adds definition to the bicep muscles. Moreover, in assisting the raising of an individual's arms while running, the apparatus disclosed herein increases the lung capacity of the individual during running, thus allowing for the increase oxygen exchange and dissolution. The apparatus ultimately increases the individual's tolerance, endurance and strength while preventing the natural swinging movement of the individual's arms while running.

The apparatus disclosed herein satisfies these long felt needs by adding the benefits of a passive workout for the oblique and bicep muscles to the common exercise of running, and solves the limitations of the prior art in a new and novel manner.

SUMMARY OF THE INVENTION

The apparatuses described herein result from the realization that an exercise apparatus may be useful for activating particular muscles, for example, the oblique and bicep muscles that are engaged when an individual is running while wearing the apparatus.

The apparatuses described herein result from the further realization that an exercise apparatus may be configured with a belt with two ends, wherein said belt is mounted on the torso region of an individual and said belt is connected to a pair of shoulder straps.

The apparatuses described herein result from the further realization that an exercise apparatus may be configured with a pair of shoulder straps comprises of two ends on each strap, whereby the ends of said shoulder straps are connected to the belt.

The apparatuses described herein result from the further realization that an exercise apparatus may be configured with a back support member positioned between and connecting to the pair of shoulder straps in the rear portion of the apparatus, whereby the back support member is mounted against the back region of the individual.

The apparatuses described herein result from the further realization that an exercise apparatus may be configured with at least one stationary hand grip element connecting and extending from the back support member positioned on the back of the individual when worn, wherein said hand grip element is configured to be grasped by an individual when worn, and further configured to retain the individual's hands in an immovable position behind the individual's neck.

The apparatuses described herein result from the further realization that an exercise apparatus may be configured with a belt with two ends, wherein said belt is mounted on the torso region of an individual and connected to a pair of shoulder straps; said pair of shoulder straps comprises of two ends on each strap, whereby the ends of the shoulder straps are connected to the belt; and at least one stationary hand grip element extending from a pair of shoulder straps, wherein said hand grip element is extending from the rear portion of said pair of shoulder straps and is configured to be grasped by an individual when worn, and wherein said hand grip element is further configured to retain the individual's hands in an immovable position behind the individual's neck.

In some embodiments of the apparatuses, a back support member is positioned between and connecting to a pair of shoulder straps in the rear portion of the apparatus, whereby the back support member is mounted against the back region of the individual.

In some embodiments, the apparatus may be configured with at least one or more stationary hand grip elements connecting and extending from the back support member positioned on the back of the individual when worn, wherein said hand grip elements are configured to be grasped by an individual when worn, and further configured to retain the individual's hands in an immovable position behind the individual's neck.

In some embodiments, the apparatus may be configured with a pair of stationary hand grip elements connecting and extending from the back support member positioned on the back of the individual when worn, wherein said hand grip elements are configured to be grasped by an individual when worn, and further configured to retain the individual's hands in an immovable position behind the individual's neck.

In some embodiments of the apparatuses, at least one or more stationary hand grip elements are extending from a pair of shoulder straps, wherein the hand grip elements are extending from the rear portion of said pair of shoulder straps.

In some embodiments of the apparatuses, a pair of stationary hand grip elements are extending from a pair of shoulder straps, wherein the hand grip elements are extending from the rear portion of said pair of shoulder straps.

In yet other embodiments of the apparatuses, at least one or more stationary hand grip elements are connecting and extending from the back support member positioned on the back of the individual when worn.

In yet other embodiments of the apparatuses, a pair of stationary hand grip elements are connecting and extending from the back support member positioned on the back of the individual when worn.

In some embodiments, the apparatus further comprises of a securement means positioned on the distal ends of the belt for adjustably securing the apparatus about the torso region of the individual. Securement means as used herein may comprise of any one or more of the following: a buckle, hook and loop, button, buttonhole, clip, zipper, hook and eye fasteners, snaps, a plurality of monofilament hooks in cooperation with a plurality of monofilament loops, most commonly known as VELCRO®, a magnet, a thread, or any other means of fastening one object to another.

In some embodiments, the apparatus further comprises of a pair of shoulder straps configured to be hung on both shoulders of an individual, extending from the rear of the apparatus to the front portion of the apparatus.

In some embodiments, the apparatus further comprises of adjustable means on said shoulder straps for adjusting each shoulder strap for said individual's comfort and fit.

In some embodiments, the apparatus further comprises at least one hand grip element extending from the rear portion of the pair of shoulder straps.

The apparatuses described herein result from the further realization that an exercise apparatus may be configured with the hand grip element located on the top portion of said shoulder straps or any other location which would allow the individual to have their hands behind their neck to engage the oblique and bicep muscles while running.

The apparatuses described herein result from the further realization that an exercise apparatus may be configured with a hand grip element and back support member; wherein the hand grip element is attached to the back support member which is detachably connected to the back region of the individual by an adhesive material, without the use of a belt or shoulder strap, wherein said hand grip element is configured to be grasped by an individual when worn, and further configured to retain the individual's hands in an immovable position behind the individual's neck.

In some embodiments, the hand grip element includes at least one aperture configured for the individual's hands to be inserted into at least one aperture. In some embodiments, the hand grip element includes at least one or more apertures configured for the individual's hands to be inserted into at least one or more apertures. In other embodiments, the hand grip element do not include any aperture, as it may include an ergonomically designed grip for the individual to grasp onto, allowing for the individual's hands to be held behind their neck while engaged in cardiovascular activity, e.g. running, jogging, walking, etc., for increased muscle development, strength, endurance and lung capacity. In other embodiments, the hand grip element is a hand strap configured to prevent the individual's fingers from slipping or sliding out of the hand grip element. In other embodiments, the hand grip element is moldable material. In other embodiments, the hand grip element is a receiving shell, like a glove. The hand grip element is formed of a material selected from the group comprising of any one or more of the following: moldable material, cloth, wool, elastic, cotton, nylon, leather, plastic, polymers, rubber, silicone, metal, padding, cushion, foam, synthetic fabric, neoprene, anti-slip fabric, anti-slide fabric, insulation, or any other types of materials that are known and used in the arts.

In some embodiments, the hand grip element is securely affixed to the back support by a fixation means known as a patch, or any other types of fixation means that are known and used in the arts.

In some embodiments, the apparatus may further include adjustable means on said belt for adjusting said belt for said individual's comfort and fit.

In some embodiments, the shoulder straps are securely affixed to the belt. Yet in other embodiments, the shoulder straps may be detachably connected to the belt by fasteners, such as, but not limited to, a buckle, a button, a magnet, a thread, a clip, a hooks and loops fastener, a zipper, glue, sticky tack, or any other means of attaching one object to another known and used in the arts.

In some embodiments, the belt and shoulder straps are adjustable.

In some embodiments of the apparatus, the belt, hand grip element and shoulder straps are elasticized and stretchable.

One of the objectives of the present invention is to provide an affordable, portable, exercise apparatus that is simple and effective, easily fitted on an individual, which will improve the cardiovascular health by increasing the lung capacity of the individual with the benefits of engaging the oblique and bicep muscles while running.

Another advantage of the present invention is that the apparatus disclosed herein involves the passive workout for the oblique and bicep muscles when the hands of the individual grasp the hand grip elements installed on the back of the apparatus while running. The apparatus disclosed herein targets, strengthens, tones and adds definition to the oblique and bicep muscles. The apparatus ultimately increases the individual's tolerance, endurance and strength while running.

Additional objectives of the present invention will appear as the description proceeds.

The forgoing and other objects and advantages will appear from the description to follow. In the description, references are made to the accompanying drawings, which forms a part hereof, and in which is shown by way of illustration specific embodiments in which the invention may be practiced. These embodiments will be described in sufficient details to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

DETAILED DESCRIPTION OF PREFERRED EMBODIMENTS

Figure 1:
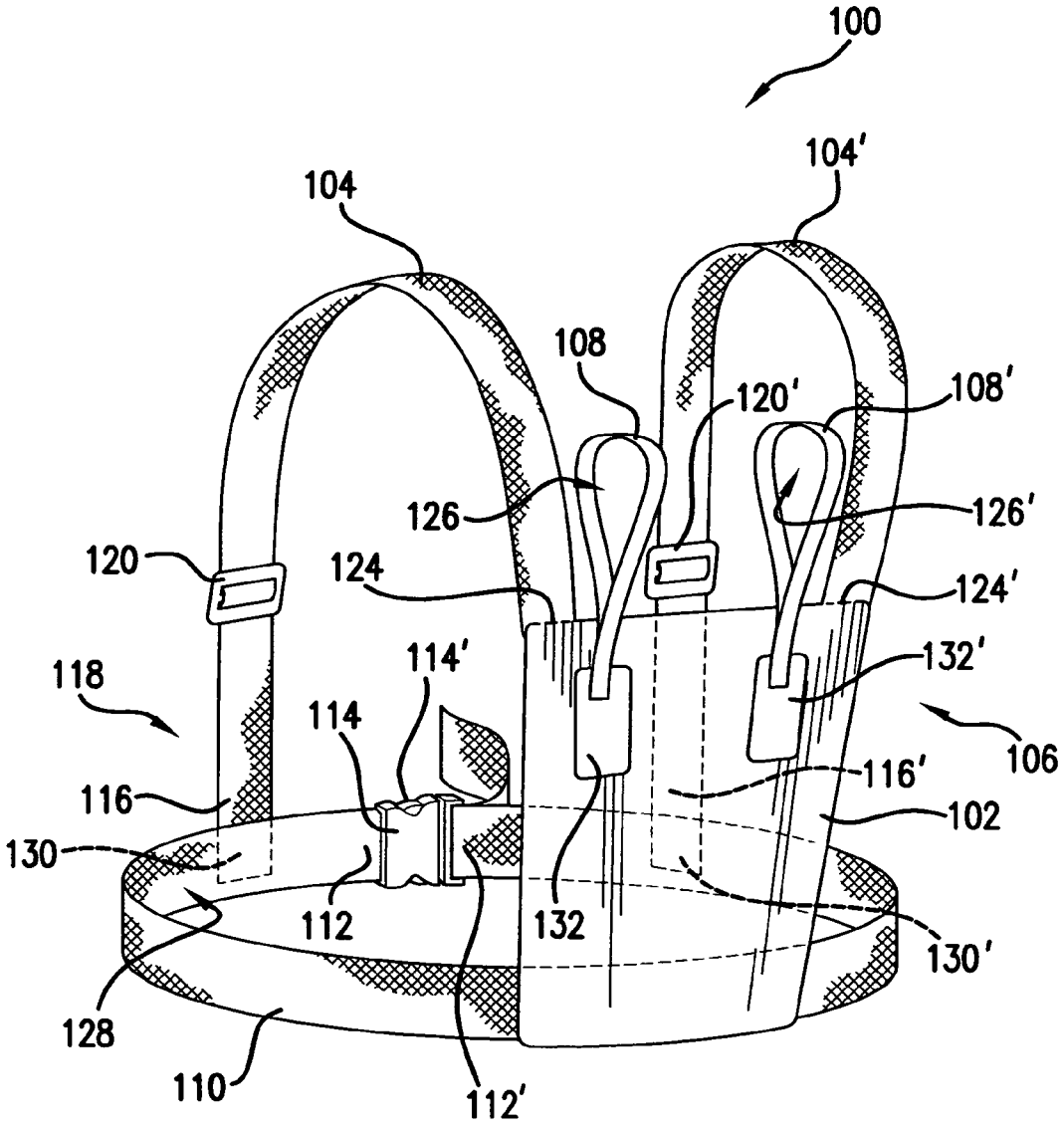
FIG. 1 shows an exercise apparatus in accordance with an embodiment of the present invention.

FIG. 1 shows an exercise apparatus 100 in accordance with one embodiment of the present invention. Exercise apparatus 100 comprises of a belt 110 with two ends 112, 112' wherein said belt 110 is to be mounted on the torso region of an individual and the belt 110 is connected to a pair of shoulder straps 104, 104'. In some embodiments, the belt 110 includes securement means 114, 114' positioned on the ends 112, 112' of the belt 110 for adjustably securing the exercise apparatus 100 about the torso region of an individual. Securement means 114, 114' comprises of any one or more of the following: a buckle, hooks, loops, a hooks-and-loops fastener, button, buttonhole, a clip, a zipper, glue, sticky tape, sticky tack, hook and eye fasteners, snaps, a plurality of monofilament hooks in cooperation with a plurality of monofilament loops, most commonly known as VELCRO®, a magnet, a thread, or any other means of fastening one object to another. The belt 110 may be adjustable by virtues of a buckle type fitting, a ring and slide adjustment, or any other means for modifying the effective length of the belt 110 known and used in the arts. In some embodiments, the belt 110 is formed from a firm but elasticized material, e.g. neoprene, suitable textile, cloth, fabric, leather, plastic, or tightly woven plastic for wearability and comfort against the individual's skin. In some embodiments, the inner face 128 of the belt 110, which makes contact with the individual's torso, may be lined for comfort and wearability with velvet, cushion, foam, fabric or any other types of materials that are known and used in the arts.

Exercise apparatus 100 further comprises of a pair of shoulder straps 104, 104' wherein the pair of shoulder straps 104, 104' comprises of two ends 116, 116' on each of the shoulder strap 104, 104' whereby the ends 116, 116' of the shoulder straps 104, 104' are connected to the belt 110. In some embodiments, the shoulder strap 104, 104' are configured to be hung on both shoulders of an individual, extending from the rear portion 106 of the exercise apparatus 100 to the front portion 118 of the exercise apparatus 100. In some embodiments, the shoulder straps 104, 104' is elasticized to provide a firm fit. In other embodiments, the shoulder straps 104, 104' comprises of adjustable means 120, 120' on the shoulder straps 104, 104' for adjusting each of the shoulder straps 104, 104' for an individual's comfort and fit. Adjustable means 120, 120' as used herein may include, but is not limited to, a ring and slide adjustment, or any other adjustable means 120, 120' that are known and used in the arts.

In some embodiments, the shoulder straps 104, 104' may be detachably connected to the belt 110 by fasteners 130, 130' such as, but not limited to, a buckle, hook and loop, button, buttonhole, clip, zipper, hook and eye fasteners, snaps, a plurality of monofilament hooks in cooperation with a plurality of monofilament loops, most commonly known as VELCRO®, a magnet, a thread, glue, sticky tack, or any other means of attaching one object to another known and used in the arts.

Exercise apparatus 100 further comprises of a back support member 102 positioned between and connecting to a pair of shoulder straps 104, 104' in the rear portion 106 of the exercise apparatus 100, whereby the back support member 102 is to be mounted against the back region of the individual. Back support member 102 may be formed from materials comprising of any one or more of the following: suitable textile, cloth, fabric, plastic, metal, sturdy, rigid or semi-rigid material. In some embodiments, the back support member 102 is elasticized. In some embodiments, the back support member 102 is securely affixed to the shoulder straps 104, 104' by stitches, buttons, magnets, a clip, a hooks-and-loops fastener, a zipper, glue, or any other means of securely attaching one object to another. In some embodiments, back support member 102 is detachably affixed to the shoulder straps 104, 104' by the seams 124, 124' of the back support member 102. The seams 124, 124' are in mating engagement with the shoulder straps 104, 104' wherein any means of attaching one object to another known and used in the arts. In other embodiments, back support member 102 is securely affixed to the shoulder straps 104, 104' in the rear portion 106 of the exercise apparatus 100.

Exercise apparatus 100 further comprises of at least one or more stationary hand grip elements, such as a pair of stationary hand grip elements 108, 108' as shown. The pair of stationary hand grip elements 108, 108' securely affixed and extending from the back support member 102 positioned in the back of the individual when worn, wherein the hand grip elements 108, 108' are configured to be grasped by an individual when worn and further configured to retain the individual's hands in an immovable position behind the individual's neck. Hand grip elements 108, 108' include at least one or more apertures 126, 126' configured for the individual's hands to be insertable into at least one or more apertures 126, 126' for activating the oblique and bicep muscles in an individual when the exercise apparatus 100 is used during an exercise activity. Hand grip elements 108, 108' are formed of a material selected from the group comprising of: moldable material, cloth, wool, elastic, cotton, nylon, leather, plastic, polymers, rubber, silicone, metal, padding, cushion, foam, synthetic fabric, neoprene, anti-slip fabric, anti-slide fabric, insulation, or any other types of materials that are known and used in the arts.

In some embodiments, the hand grip elements 108, 108' are securely affixed to the back support member 102 by a fixation means 132, 132' known as a patch, or any other types of fixation means that are known and used in the arts.

In some embodiments, the belt 110, hand grip elements 108, 108' and shoulder straps 104, 104' are elasticized and stretchable.

Figure 2:
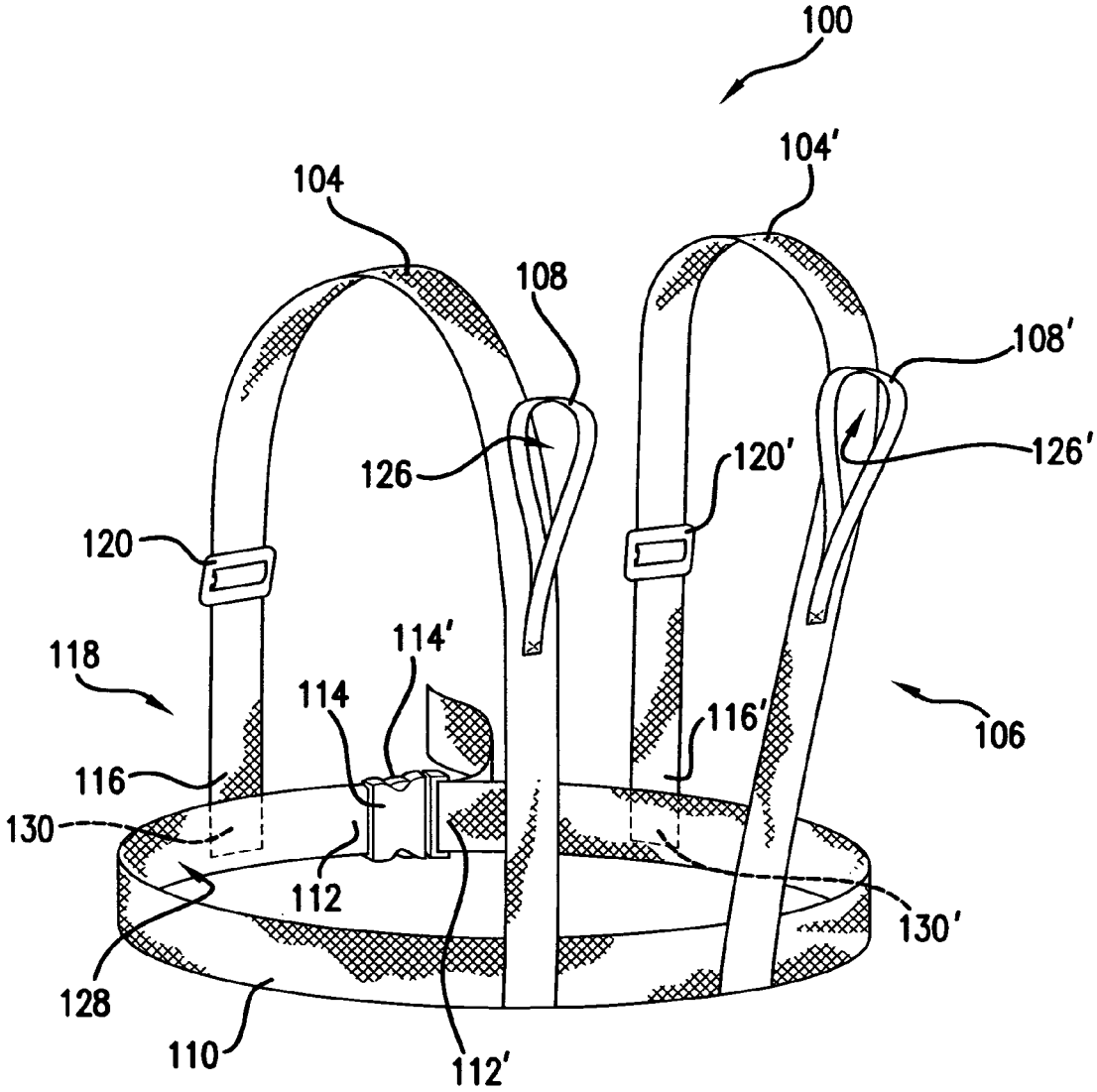
FIG. 2 shows an exercise apparatus in accordance with another embodiment of the present invention.

FIG. 2 shows an exercise apparatus in accordance with another embodiment of the present invention. Exercise apparatus 100 comprises of a belt 110 with two ends 112, 112' wherein said belt 110 is to be mounted on the torso region of the individual and the belt 110 is connected to a pair of shoulder straps 104, 104'. In some embodiments, the belt 110 includes securement means 114, 114' positioned on the ends 112, 112' of the belt 110 for adjustably securing the exercise apparatus 100 about the torso region of the individual. Securement means 114, 114' comprises of any one or more of the following: a buckle, hooks, loops, a hooks-and-loops fastener, button, buttonhole, a clip, a zipper, glue, sticky tape, sticky tack, hook and eye fasteners, snaps, a plurality of monofilament hooks in cooperation with a plurality of monofilament loops, most commonly known as VELCRO®, a magnet, a thread, or any other means of fastening one object to another. The belt 110 may be adjustable by virtues of a buckle type fitting, a ring and slide adjustment, or any other means for modifying the effective length of the belt 110 known and used in the arts. In some embodiments, the belt 110 is formed from a firm but elasticized material, e.g. neoprene, suitable textile, cloth, fabric, leather, plastic, or tightly woven plastic for wearability and comfort against the individual's skin. In some embodiments, the inner face 128 of the belt 110, which makes contact with the individual's torso, may be lined for comfort and wearability with velvet, cushion, foam, fabric or any other types of materials that are known and used in the arts.

Exercise apparatus 100 further comprises of a pair of shoulder straps 104, 104' wherein the pair of shoulder straps 104, 104' comprises of two ends 116, 116' on each of the shoulder strap 104, 104' whereby the ends 116, 116' of the shoulder straps 104, 104' are connected to the belt 110. In some embodiments, the shoulder strap 104, 104' are configured to be hung on both shoulders of an individual, extending from the rear portion 106 of the exercise apparatus 100 to the front portion 118 of the exercise apparatus 100. In some embodiments, the shoulder straps 104, 104' is elasticized to provide a firm fit. In other embodiments, the shoulder straps 104, 104' comprises of adjustable means 120, 120' on the shoulder straps 104, 104' for adjusting each of the shoulder straps 104, 104' for the individual's comfort and fit. Adjustable means 120, 120' as used herein may include, but is not limited to, a ring and slide adjustment, or any other adjustable means 120, 120' that are known and used in the arts.

In some embodiments, the shoulder straps 104, 104' may be detachably connected to the belt 110 by fasteners 130, 130' such as, but not limited to, a buckle, hook and loop, button, buttonhole, clip, zipper, hook and eye fasteners, snaps, a plurality of monofilament hooks in cooperation with a plurality of monofilament loops, most commonly known as VELCRO®, a magnet, a thread, glue, sticky tack, or any other means of attaching one object to another known and used in the arts.

Exercise apparatus 100 further comprises of at least one or more stationary hand grip elements, such as a pair of stationary hand grip elements 108, 108' as shown. The pair of stationary hand grip elements 108, 108' extending from a pair of shoulder straps 104, 104', wherein said hand grip elements 108, 108' are extending from the rear portion of said pair of shoulder straps 104, 104' and are configured to be grasped by the individual when worn, and wherein said hand grip elements 108, 108' are further configured to retain the individual's hands in an immovable position behind the individual's neck. Hand grip elements 108, 108' include at least one or more apertures 126, 126' configured for the individual's hands to be insertable into the at least one or more apertures 126, 126' for activating the oblique and bicep muscles in an individual when the exercise apparatus 100 is used during an exercise activity. Hand grip elements 108, 108' are formed of a material selected from the group comprising of moldable material, cloth, wool, elastic, cotton, nylon, leather, plastic, polymers, rubber, silicone, metal, padding, cushion, foam, synthetic fabric, neoprene, anti-slip fabric, anti-slide fabric, insulation, or any other types of materials that are known and used in the arts.

In some embodiments, the belt 110, hand grip elements 108, 108' and shoulder straps 104, 104' are elasticized and stretchable.

Figure 3:
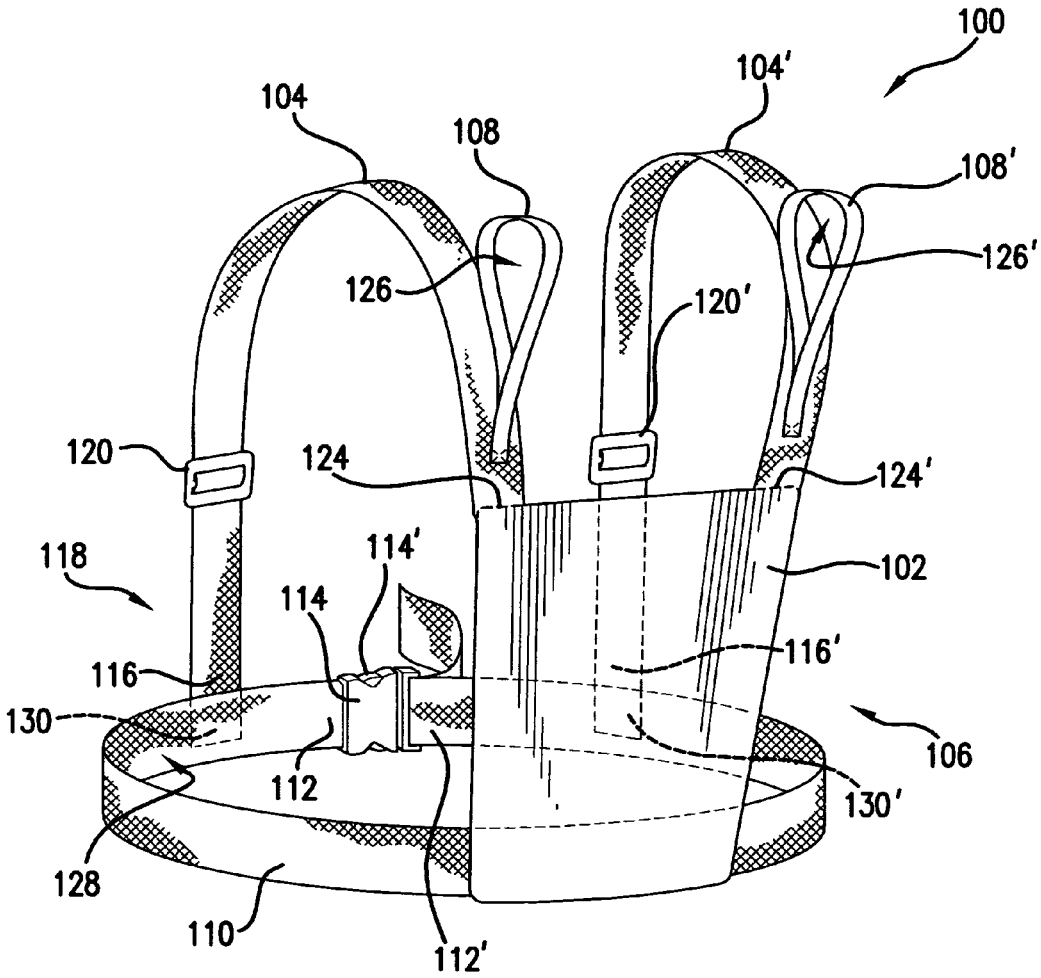
FIG. 3 shows an exercise apparatus in accordance with yet another embodiment of the present invention.

FIG. 3 shows an exercise apparatus in accordance with yet another embodiment of the present invention. Exercise apparatus 100 comprises of a belt 110 with two ends 112, 112' wherein said belt 110 is to be mounted on the torso region of the individual and the belt 110 is connected to a pair of shoulder straps 104, 104'. In some embodiments, the belt 110 includes securement means 114, 114' positioned on the ends 112, 112' of the belt 110 for adjustably securing the exercise apparatus 100 about the torso region of the individual. Securement means 114, 114' comprises of any one or more of the following: a buckle, hooks, loops, a hooks-and-loops fastener, button, buttonhole, a clip, a zipper, glue, sticky tape, sticky tack, hook and eye fasteners, snaps, a plurality of monofilament hooks in cooperation with a plurality of monofilament loops, most commonly known as VELCRO®, a magnet, a thread, or any other means of fastening one object to another. The belt 110 may be adjustable by virtues of a buckle type fitting, a ring and slide adjustment, or any other means for modifying the effective length of the belt 110 known and used in the arts. In some embodiments, the belt 110 is formed from a firm but elasticized material, e.g. neoprene, suitable textile, cloth, fabric, leather, plastic, or tightly woven plastic for wearability and comfort against the individual's skin. In some embodiments, the inner face 128 of the belt 110, which makes contact with the individual's torso, may be lined for comfort and wearability with velvet, cushion, foam, fabric or any other types of materials that are known and used in the arts.

Exercise apparatus 100 further comprises of a pair of shoulder straps 104, 104' wherein the pair of shoulder straps 104, 104' comprises of two ends 116, 116' on each of the shoulder strap 104, 104' whereby the ends 116, 116' of the shoulder straps 104, 104' are connected to the belt 110. In some embodiments, the shoulder strap 104, 104' are configured to be hung on both shoulders of an individual, extending from the rear portion 106 of the exercise apparatus 100 to the front portion 118 of the exercise apparatus 100. In some embodiments, the shoulder straps 104, 104' is elasticized to provide a firm fit. In other embodiments, the shoulder straps 104, 104' comprises of adjustable means 120, 120' on the shoulder straps 104, 104' for adjusting each of the shoulder straps 104, 104' for the individual's comfort and fit. Adjustable means 120, 120' as used herein may include, but is not limited to, a ring and slide adjustment, or any other adjustable means 120, 120' that are known and used in the arts.

In some embodiments, the shoulder straps 104, 104' may be detachably connected to the belt 110 by fasteners 130, 130' such as, but not limited to, a buckle, hook and loop, button, buttonhole, clip, zipper, hook and eye fasteners, snaps, a plurality of monofilament hooks in cooperation with a plurality of monofilament loops, most commonly known as VELCRO®, a magnet, a thread, glue, sticky tack, or any other means of attaching one object to another known and used in the arts.

Exercise apparatus 100 further comprises of at least one or more stationary hand grip elements, such as a pair of stationary hand grip elements 108, 108' as shown. The pair of stationary hand grip elements 108, 108' extending from a pair of shoulder straps 104, 104', wherein said hand grip elements 108, 108' are extending from the rear portion of said pair of shoulder straps 104, 104' and are configured to be grasped by the individual when worn, and wherein said hand grip elements 108, 108' are further configured to retain the individual's hands in an immovable position behind the individual's neck. Hand grip elements 108, 108' include at least one or more apertures 126, 126' configured for the individual's hands to be insertable into the at least one or more apertures 126, 126' for activating the oblique and bicep muscles in an individual when the exercise apparatus 100 is used during an exercise activity. Hand grip elements 108, 108' are formed of a material selected from the group comprising of: moldable material, cloth, wool, elastic, cotton, nylon, leather, plastic, polymers, rubber, silicone, metal, padding, cushion, foam, synthetic fabric, neoprene, anti-slip fabric, anti-slide fabric, insulation, or any other types of materials that are known and used in the arts.

Exercise apparatus 100 further comprises of a back support member 102 positioned between and connecting to a pair of shoulder straps 104, 104' in the rear portion 106 of the exercise apparatus 100, whereby the back support member 102 is mounted against the back region of the individual. Back support member 102 may be formed from materials comprising of any one or more of the following: suitable textile, cloth, fabric, plastic, metal, sturdy, rigid or semi-rigid material. In some embodiments, the back support member 102 is elasticized. In some embodiments, the back support member 102 is securely affixed to the shoulder straps 104, 104' by stitches, buttons, magnets, a clip, a hooks-and-loops fastener, a zipper, glue, or any other means of securely attaching one object to another. In some embodiments, back support member 102 is detachably affixed to the shoulder straps 104, 104' by the seams 124, 124' of the back support member 102. The seams 124, 124' are in mating engagement with the shoulder straps 104, 104' wherein any means of attaching one object to another known and used in the arts. In other embodiments, back support member 102 is securely affixed to the shoulder straps 104, 104' in the rear portion 106 of the exercise apparatus 100.

In some embodiments, the belt 110, hand grip elements 108, 108' and shoulder straps 104, 104' are elasticized and stretchable.

Figure 4:
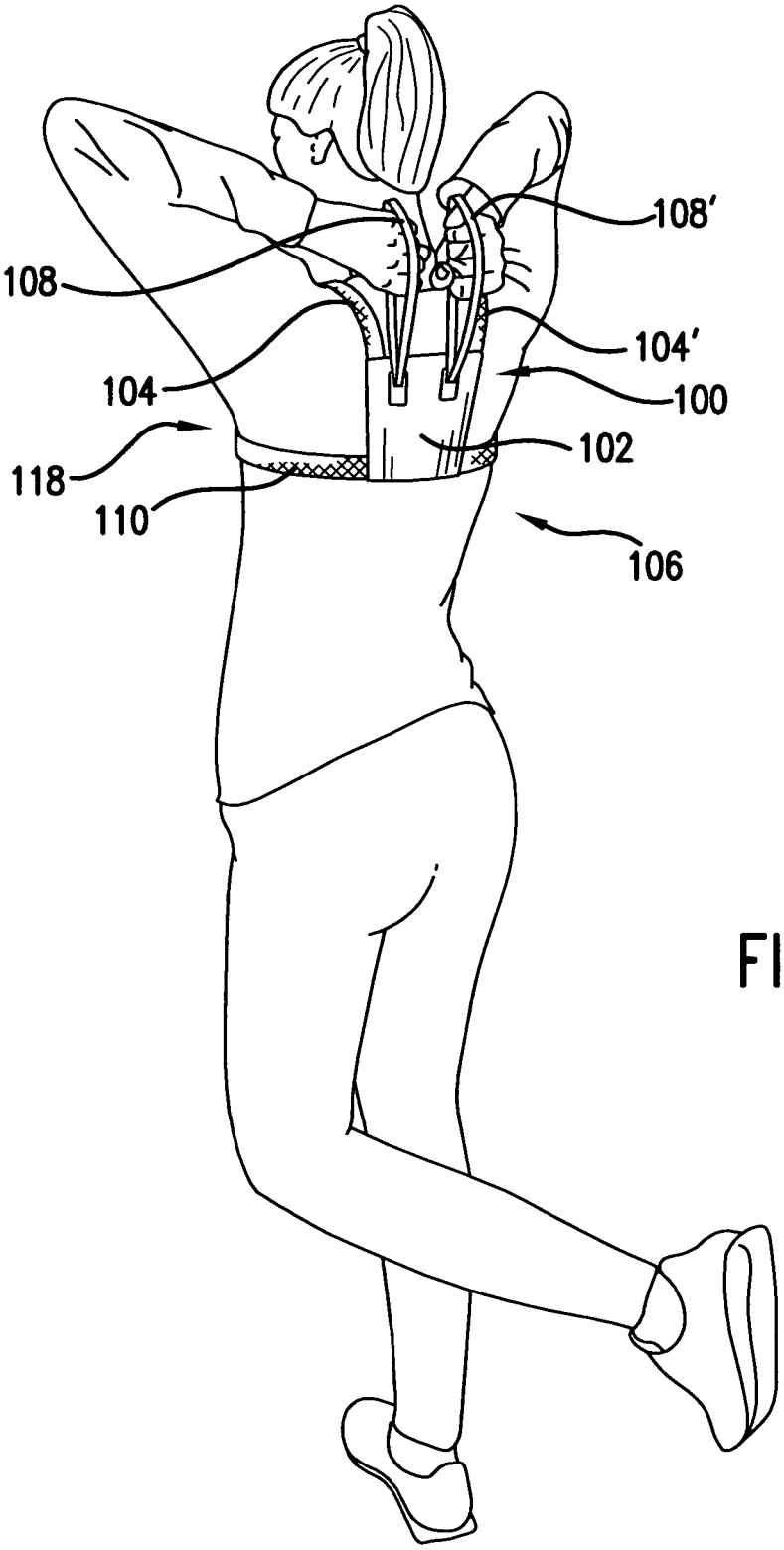
FIG. 4 shows an individual wearing exercise apparatus 100 according to one embodiment of the present invention while running.

FIG. 4 shows an individual wearing exercise apparatus 100 according to one embodiment of the present invention while running. The rear portion 106 of exercise apparatus 100 is shown. Exercise apparatus 100 comprises of the belt 110 mounted on the torso region of an individual and connected to a pair of shoulder straps 104, 104'; a pair of shoulder straps 104, 104' are hung on both shoulders of the individual and are connected to the belt 110; a back support member 102 positioned between and connecting to a pair of shoulder straps 104, 104' in the rear portion 106 of the exercise apparatus 100, whereby the back support member 102 is mounted against the back region of the individual; and a pair of stationary hand grip elements 108, 108' securely affixed and extending from the back support member 102 positioned in the back of the individual when the exercise apparatus is worn, wherein the hand grip elements 108, 108' are grasped by an individual and retain the individual's hands in an immovable position behind the individual's neck.

In some embodiments, the shoulder straps 104, 104' are configured to be hung on both shoulders of an individual, extending from the rear portion 106 of the exercise apparatus 100 to the front portion 118 of the exercise apparatus 100. In some embodiments, the shoulder straps 104, 104' is elasticized to provide a firm fit.

Exercise apparatus 100 involves the passive workout for the oblique and bicep muscles while the individual is running. When the hands of the individual grasp the handle grip elements 108, 108' on the rear portion 106 of the apparatus 101, the individual's hands are held stationary behind the neck while running. This activates the oblique and bicep muscles, thereby providing a passive workout for these muscles while running, where the individual's natural bodyweight is the only resistance. The handle grip elements 108, 108' permits the arms to be raised up over the individual's head and the hands held stationary behind the neck, exposing the oblique muscles, increasing the tension and stress on the oblique muscles, and at the same engaged and exposed the bicep muscles to the natural stress and tension, for the duration of time that the individual is running. Thus the apparatus disclosed herein targets, strengthens, tones and adds definition to the oblique and bicep muscles. Exercise apparatus 100 ultimately increases the individual's tolerance, endurance and strength while preventing the natural swinging movement of the individual's arms while running.

While the principles of the disclosure have been described herein, it is to be understood by those skilled in the art that this description is made only by the way of example and not as a limitation as to the scope of the disclosure. Other embodiments are contemplated within the scope of the present disclosure in addition to the exemplary embodiments shown and described herein. Modifications, variations and substitutions by one of ordinary skill in the art are considered within the scope of the present disclosure.

What is claimed is:

1. An exercise apparatus, comprising:

a) a belt with two ends, wherein said belt is mountable on the torso region of an individual wearer, said belt is connected to a pair of shoulder straps;

b) said pair of shoulder straps connected to said belt, wherein each of said shoulder straps includes two ends wherein one of said ends of each of said shoulder straps is connected to said belt;

c) a back support member positioned between and connecting to said pair of shoulder straps in the rear portion of said apparatus, wherein said back support member is mountable against the back region of the individual wearer; and, d) at least one stationary hand grip element connected to and extended from said back support member that is mountable on back of said individual wearer, said at least one hand grip element is sized and shaped to be grasped by the individual wearer and further sized and shaped to retain the individual wearer's hands in a generally immovable position behind and adjacent the individual's neck.

2. The exercise apparatus of claim 1 wherein said apparatus further comprises securement means positioned on said ends of said belt for adjustably securing said apparatus about the torso region of the individual wearer.

3. The exercise apparatus of claim 2 wherein said securement means is selected from the group consisting of a buckle, hook and loop fastener, button, buttonhole, clip, zipper, hook and eye fastener, snap, a plurality of monofilament hooks in cooperation with a plurality of monofilament loops, a magnet, a thread and combinations thereof.

4. The exercise apparatus of claim 1 wherein each of said pair of shoulder straps are configured to be hung each on one shoulder of the individual wearer, extending from the rear of said apparatus to a front portion of said apparatus.

5. The exercise apparatus of claim 1 wherein said apparatus further comprises adjustable means on said shoulder straps for adjusting each shoulder strap for the individual wearer's comfort and fit.

6. The exercise apparatus of claim 1 wherein said hand grip includes an aperture for insertion of a hand of the individual user.

7. The exercise apparatus of claim 1 wherein said at least one hand grip element is formed of a material selected from the group consisting of moldable material selected from the group consisting of cloth, wool, elastic, cotton, nylon, plastic, polymer, rubber, silicone, metal, padding, cushion, foam, synthetic, fabric, neoprene, anti-slip fabric, anti-slide fabric, insulation, and combinations thereof.

8. The exercise apparatus of claim 1 wherein said hand grip element is securely affixed to said back support by fixation means.

9. The exercise apparatus of claim 1 wherein said belt, and said shoulder straps are elasticized and stretchable.

10. The exercise apparatus of claim 1 wherein said apparatus further comprises adjustable means on said belt for adjusting said belt for the individual's comfort and fit.

* * * * *